United States Patent [19]

Ducourant

[11] 4,285,530

[45] Aug. 25, 1981

[54] HAND HELD SKIING STABILIZER

[76] Inventor: Jacques F. Ducourant, 1823 W. 700 North, Salt Lake City, Utah 84104

[21] Appl. No.: 8,248

[22] Filed: Feb. 1, 1979

[51] Int. Cl.[3] ..... A63C 11/00

[52] U.S. Cl. ..... 280/809; 16/110 R; 89/36 D; 109/49.5; D21/230

[58] Field of Search ..... 280/11.37 R, 11.37 E, 280/11.37 A, 11.37 H, 11.37 S; 89/36 D, 36 E, 36 F; 114/39, 102, 103; 2/2.5, 16, 20; 16/110 R, 110.5; 109/49.5; 169/48; 24/183; 46/1 R; 272/143; 220/94 R, 94 A, 256; D21/229, 230; D22/99

[56] References Cited

U.S. PATENT DOCUMENTS

| | | | |
|---|---|---|---|
| 1,031,053 | 7/1912 | Danz | 220/256 |
| 2,577,917 | 12/1951 | Root | 280/11.37 S X |
| 2,793,870 | 5/1957 | Bowman | 280/11.37 S |
| 3,179,287 | 4/1965 | Rickmeier, Jr. | 220/94 R |
| 3,829,899 | 8/1974 | Davis | 2/2.5 |
| 3,831,805 | 8/1974 | Yonce | 220/94 A |
| 3,874,686 | 4/1975 | Shipstad | 280/11.37 H |
| 4,011,740 | 3/1977 | Ljungberg | 280/11.37 A X |
| 4,030,414 | 6/1977 | McGuire | 16/110 R X |

FOREIGN PATENT DOCUMENTS

| | | | |
|---|---|---|---|
| 78222 | 2/1919 | Fed. Rep. of Germany | 2/2.5 |
| 1119475 | 12/1961 | Fed. Rep. of Germany | 220/256 |

*Primary Examiner*—Joseph F. Peters, Jr.
*Assistant Examiner*—Donald W. Underwood
*Attorney, Agent, or Firm*—Mallinckrodt & Mallinckrodt

[57] ABSTRACT

A hand-held skiing stabilizer has a stabilizer body and a handle extending into the body so that a hand grasping the handle does not pass entirely through the stabilizer. A preferred stabilizer comprises a pair of similarly shaped sheets of semirigid material attached together about their edges. Hand holes extend through one of the sheets inwardly from the edge margins thereof to form a handle. Structure is provided about the hand holes and between the two sheets to spread and hold apart the two sheets so that a hand grasping the handle passes partially through the hand holes in the one sheet but does not pass through the other sheet. It is preferred that a hole be provided in the sheet that does not have the handle and that a tongue extend from attachment inside the stabilizer through the hole so that two similar stabilizers may be interconnected by means of said tongues and holes for ease of carrying.

6 Claims, 6 Drawing Figures

HAND HELD SKIING STABILIZER

BACKGROUND OF THE INVENTION

1. Field

The invention is in the field of devices which may be used instead of ski poles when skiing.

2. State of the Art

Use has been made recently on a very limited basis of relatively flat sheets of rigid or semirigid material of various shapes which may be held in the hands of a skier in place of ski poles when skiing. These sheets of material have a relatively large surface area on the two flat sides and relatively narrow edges. Thus, when the sheets are held so that the edges face the direction of travel, they cut through the air with very little resistance, but when turned, even slightly, exert acrodynamic forces on the skier. The use of these sheets, or skiing stabilizers as they are called herein, add an interesting variation to the sport of skiing. Their use can help a skier remain in upright skiing positions, help him turn, help with other interesting maneuvers, or may merely add another challenge to the sport.

The stabilizers previously in use were merely a single sheet of material, usually of rhombus shape with hand holes provided for holding the sheet. Even a modified oval shaped stabilizer, in which two sheets of material were joined together about their edges to form the stabilizer, see my copending design patent application, Ser. No. 903,978 filed May 8, 1978, had hand holes for the handle extending completely through the stabilizer. Such arrangement leaves a portion of the hand exposed on the outer side of the stabilizers. Even though ski gloves are worn, the extension of the hand completely through the stabilizer is undesirable in many instances.

SUMMARY OF THE INVENTION

According to the invention, a hand-held skiing stabilizer includes a stabilizer body and a handle extending into the body so that a hand grasping the handle does not pass entirely through the stabilizer. A preferred stabilizer comprises a pair of similarly shaped sheets of semirigid material attached together about their edges and hand holes that form a handle extending through one of the sheets. Means, such as a box structure, is provided between the sheets in the area of the hand holes to spread and hold apart the two sheets, so that a hand grasping the handle passes partially through the hand holes in the one sheet, but does not pass through the other sheet. In this way none of the hand is exposed on the outside of the stabilizer.

With the hand holes provided in only one sheet of the stabilizer, so that a hand cannot reach completely through the stabilizer, a problem arises in conveniently carrying two such stabilizers when also carrying skis or when riding ski lifts where one hand should be free. With the older type stabilizer, where the hand reached all the way through, two stabilizers could easily be held in one hand. In the stabilizer of the present invention, where the hand cannot reach completely through the stabilizer, means are advantageously provided for interconnecting two stabilizers for ease of carrying.

An effective means for interconnecting two stabilizers is through the provision of a hole in the one sheet which does not have the handle and the further provision of a tongue attached to the inside of the stabilizer and extending through the hole and outwardly from the stabilizer. The tongues are then lined up on the two stabilizers and the two are forced together so that the tongues slide along each other and are held in the holes. It is preferred that one stabilizer of a pair have the tongue extending in an upward direction away from the stabilizer and the other have the tongue extending in a downward direction. In this way, the two stabilizers will be interconnected with the same orientation.

THE DRAWINGS

The best mode presently contemplated for carrying out the invention is shown in the accompanying drawings, in which:

FIG. 1 is a perspective view of a skier holding a skiing stabilizer of the invention in each hand;

FIG. 2, an exploded view of the skiing stabilizer showing how the pieces are assembled;

FIG. 3, a perspective view of two of the skiing stabilizers mounted together in carrying position;

FIG. 4, a side elevation of the skiing stabilizers shown in FIG. 3;

FIG. 5, a fragmentary vertical section taken on the line 5—5 of FIG. 3 and drawn to a larger scale; and FIG. 6, a similar but horizontal section taken on the line 6—6 of FIGS. 4 and 5.

DETAILED DESCRIPTION OF THE ILLUSTRATED EMBODIMENT

As illustrated, a preferred embodiment of the present invention is constructed of two similarly shaped sheets 10 and 11 of semirigid material. The presently preferred shape is a modified oval as shown and the presently preferred material is one-eighth inch thick corrugated plastic sheet material. This material is similar to corrugated cardboard in construction, but made of plastic rather than cardboard.

Figure 2:
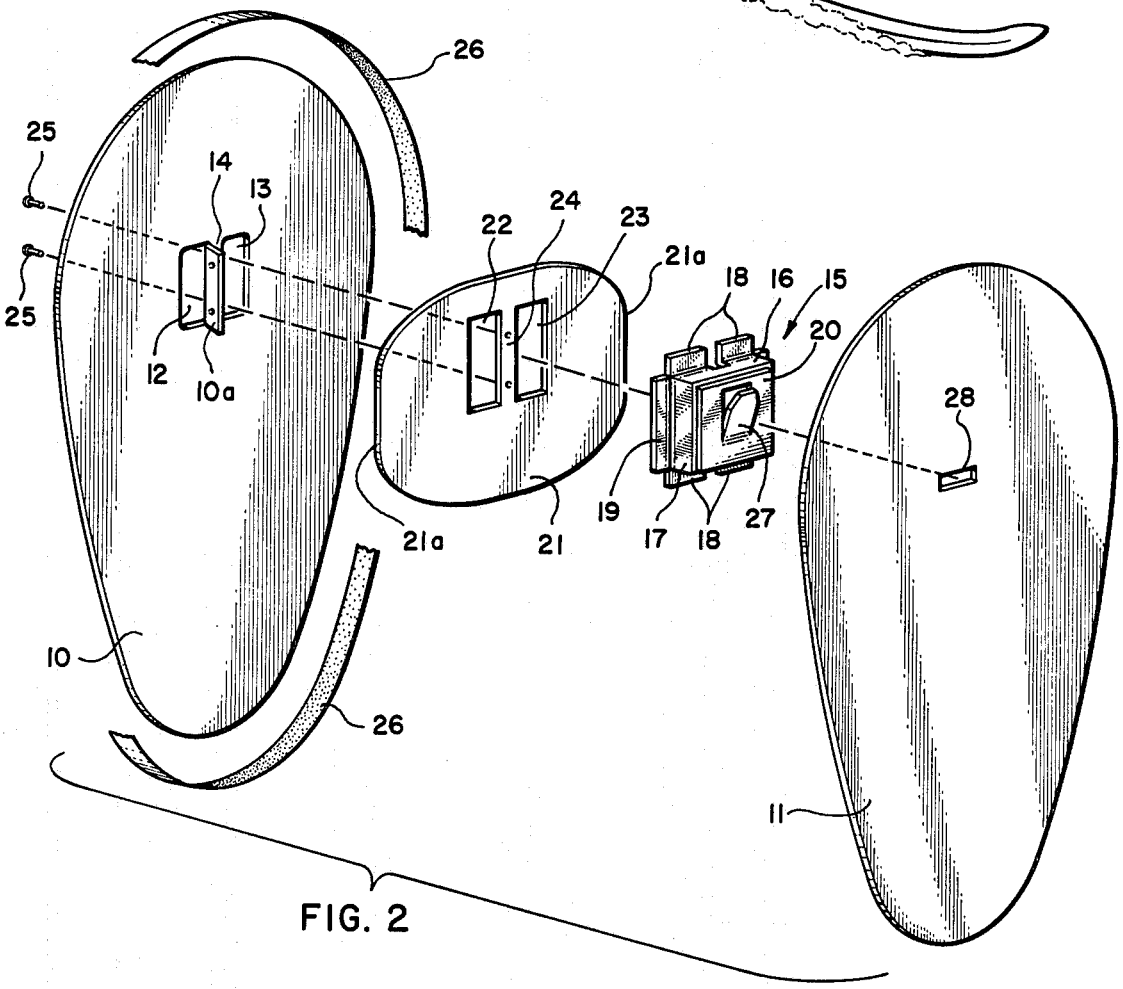
Figure 3:
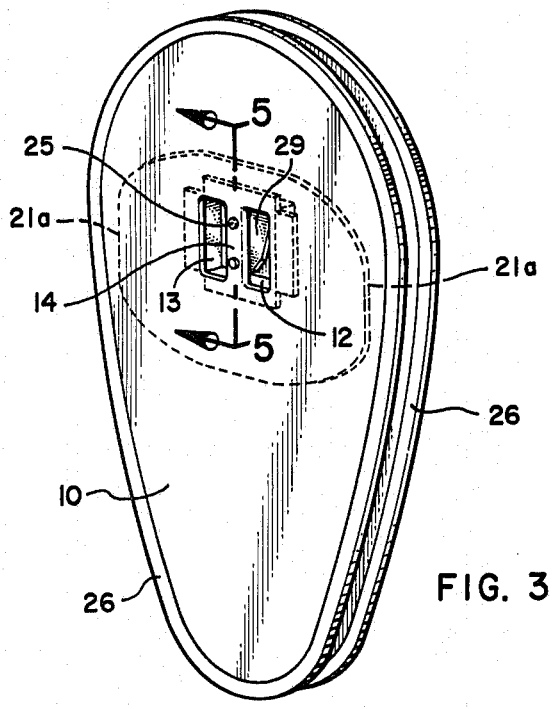

Sheet 10 has two hand holes 12 and 13, FIGS. 2 and 3, cut therein so that a bar 14 is formed between the two holes. The hand holes are located inwardly from the edge margins of the sheet 10 and, for the shape shown, are preferably located one on either side of the longitudinal axis of the sheet. The location of the hand holes will vary with the shape of the sheet.

In order to spread the two sheets and hold them apart in the area of the handle so that bar 14 may be grasped, an open box structure 15, FIG. 2, is provided having respective pairs of side walls 16 and 17, side wall flanges 18 and 19 associated with pairs of side walls 16 and 17 respectively, and back wall 20. The front 21, FIG. 6, of the box structure is open. Box structure 15 is large enough so that, when placed against sheet 10 in proper position, it extends about the perimeter of the hand holes 12 and 13 thereby completely surrounding hand holes 12 and 13, FIG. 3, to form an enclosed area for a hand when grasping bar 14. Box structure 15 may be attached to sheet 10 in any suitable manner such as by gluing flanges 18 and 19 to sheet 10, attaching flanges 18 and 19 to sheet 10 by heat treatment, or preferably, by holding flanges 18 and 19 against sheet 10 by means of reinforcing piece 21 as illustrated. Other structures for spreading the sheets could be used such as a strip with flanges that would be similar to box structure 15 but without the back 20, or merely a block of material secured between the two sheets.

Reinforcing piece 21, conveniently made of the same material as sheets 10 and 11, has hand holes 22 and 23 cut therein forming a bar 24 therebetween. The hand holes and bar correspond to hand holes 12 and 13 and bar 14 in sheet 10. Reinforcing piece 21 is secured to sheet 10 by any suitable means such as by heat treating along edges 21*a* whereby the plastic along edges 21*a* is bonded to the plastic of sheet 10. Such attachment is made so that holes 12 and 22, 13 and 23, and bars 14 and 24 line up. When cutting hole 12 in sheet 10, it is preferred to leave attached to bar 14, as a flap, a portion 10*a* of sheet 10 that would otherwise be cut out and discarded, see FIGS. 2, 5 and 6. After reinforcing piece 21 is in place, flap 10*a* is folded over, FIG. 6, and preferably riveted in place with rivits 25. This further attaches reinforcing piece 21 to sheet 10 and reinforces the handle formed by bars 14 and 24. Box structure 15 is secured to sheet 10 by slipping flanges 18 and 19 into place between sheet 10 and reinforcing piece 21, FIGS. 5 and 6.

Box structure 15 may conveniently be made of the same sheet material as sheets 10 and 11. The sheet material is cut and scored so that it can be folded to form the box structure. In such instance, flanges 18 and 19, when secured in place against sheet 10, will hold box structure 15 in its folded, box shape.

Figure 4:
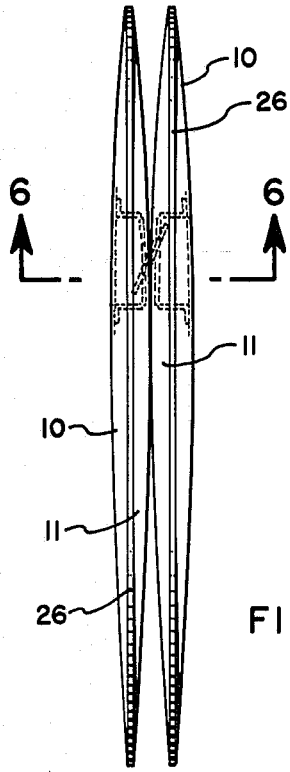

Sheet 11 is secured about its edges to sheet 10 in any suitable manner such as by plastic tape 26. With the edges of sheets 10 and 11 secured together, the sheets will bend outwardly to accommodate box structure 15 in the area of the handle, FIG. 4. Box structure 15 is just deep enough so that a hand, with ski glove thereon, will fit in and easily grasp bar 14. One and one-half inches is usually sufficient depth for box structure 15, resulting in an overall maximum spread between sheets 10 and 11 of approximately two inches. Thus, the sheet material has to be flexible enough to accommodate the spread. Rather than using a semirigid material that will flex when sheets 10 and 11 are joined, sheets 10 and 11 could be molded in the desired shape of a rigid material, or the whole stabilizer could be molded in one or more rigid pieces.

It is preferred that box structure 15 substantially form a closed handle compartment so that snow cannot get between the sheets 10 and 11, other than within box structure 15.

Figure 1:
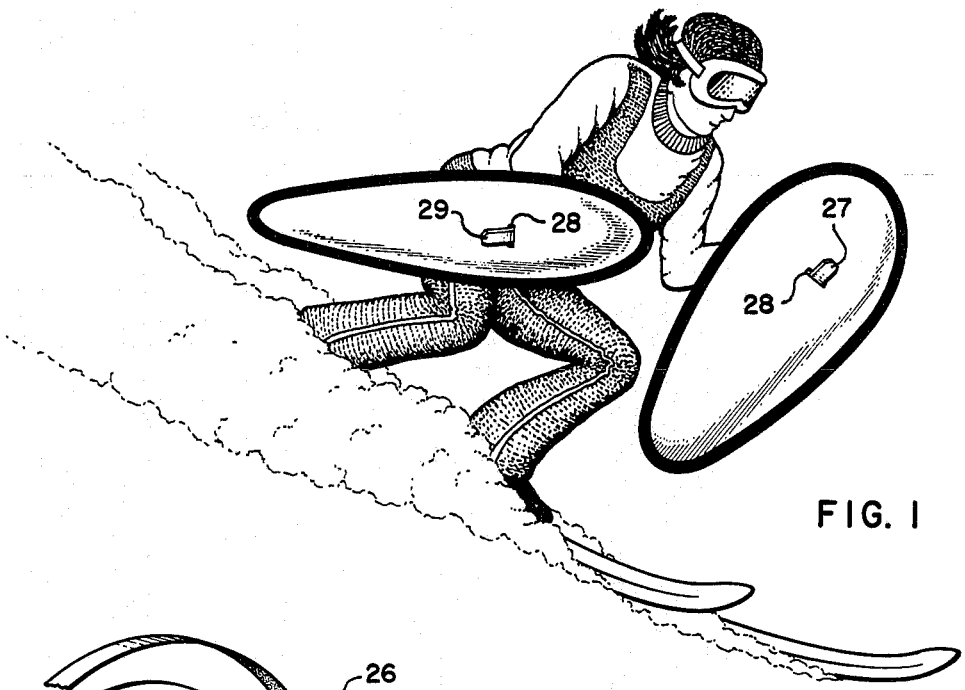

In use, the stabilizers are generally used in pairs so that a skier can hold one stabilizer in each hand, as shown in FIG. 1. By holding the stabilizers in different positions relative to the movement of the skier, different aerodynamic effects are produced by the stabilizers and thus on the skier holding the stabilizers. Since the stabilizers are generally used in pairs, and since the hand cannot extend completely through one stabilizer to conveniently hold the second one when riding a ski lift or carrying skis, where one hand has to be free, means are provided to interconnect two of the stabilizers so they may both conveniently be carried in one hand.

In the preferred embodiment illustrated, a tongue 27 is cut into the back 20 of box structure 15. A hole 28 is provided in sheet 11 so that when sheets 10 and 11 are joined, tongue 27 will extend through hole 28 in an upward and outward direction. The tongue 27 and hole 28 are positioned so that by rotating the box structure 180°, the tongue will still extend through hole 28, but will do so in a downward and outward direction. This rotation has been done and is illustrated in FIGS. 1, 4, 5, and 6 in a second stabilizer wherein the downwardly directed tongue is labeled 29. All other parts of the second stabilizer shown are identical to those described for the first stabilizer. It is preferred that each pair of stabilizers to be used by a skier will have one tongue extending upwardly and one extending downwardly.

Figure 5:
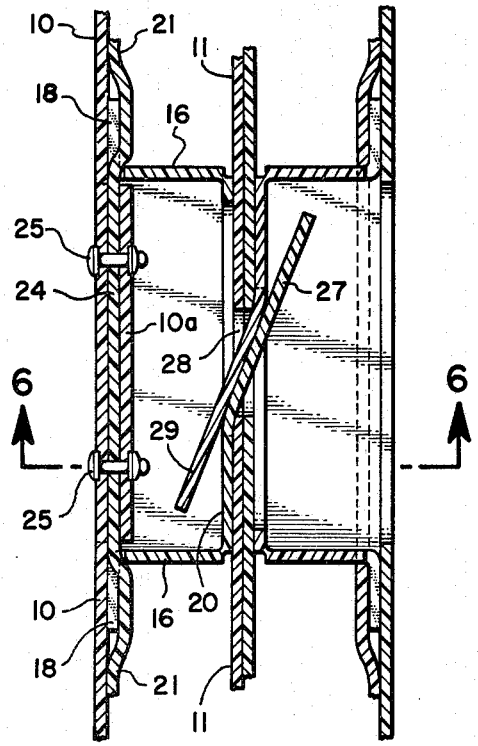
Figure 6:
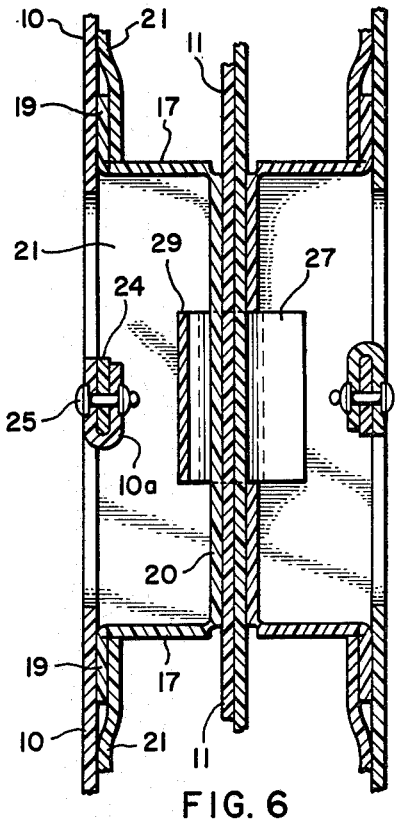

When it is desired to interconnect the stabilizers, the tongues are merely lined up, the downward tongue 29 on top of the upward tongue 27, and the stabilizers pushed together so that the tongues slide along each other and through the holes 28, FIGS. 5 and 6. The holes 28 are of a size so that the two tongues fit snugly therein. In this way the stabilizers are firmly mounted together and may be carried in one hand by grasping the handle of one of the stabilizers in the normal manner. If two stabilizers to be carried both have either upward or downward tongues, they are mounted together in similar fashion as described by turning one of the stabilizers upside down so that the tongues point oppositely.

In addition to providing means for interconnecting two stabilizers, tongue 27 passing through slot 28 attaches sheet 11 to box structure 15, strengthening the entire stabilizer.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A hand-held skiing stabilizer comprising a pair of similarly shaped sheets of semirigid material; means attaching said sheets together about their edges; two holes through one of said sheets in spaced, side-by-side relationship forming a bar between the two holes so that a hand may be inserted to grasp the bar; box structure positioned between the two sheets to spread and hold the two sheets apart in the area of the handle, so that a hand grasping the bar does not pass through the second sheet, said box structure being of a size so that the edges of the box structure extend about the perimeter of the holes through the one sheet, and having flanges adjacent to one of the sheets; a reinforcing piece, smaller than the sheets, attached to one of the sheets and arranged to hold the flanges of the box structure against the sheet to which the reinforcing piece is attached, the box structure extending through the reinforcing piece to the opposite sheet.

2. A hand-held skiing stabilizer according to claim 1, wherein the reinforcing piece is attached to the sheet having the handle, and wherein the reinforcing piece has holes corresponding to those in the said sheet and forming a bar between the holes, which bar corresponds to the bar of the said sheet, the reinforcing piece being aligned with the said sheet so that the holes and the bars coincide, the bar of the reinforcing piece reinforcing the bar of the said sheet.

3. A hand-held skiing stabilizer according to claim 2, wherein a portion of the sheet material that is cut to provide a hole is left attached to the sheet along the bar and is folded over on the bar as reinforcement for the bar.

4. A hand-held skiing stabilizer according to claim 3, additionally comprising a hole formed in that sheet which does not have the handle means, and a tongue extending from attachment inside the stabilizer, through the hole and away from the stabilizer, so that two similar stabilizers may be interconnected by means of said tongues and said holes for ease of carrying.

5. A hand-held skiing stabilizer according to claim 4, wherein the box structure has a tongue cut therein where it abuts that sheet which does not have the handle means, and wherein the hole in said sheet not having the handle means is located so as to receive said tongue of the box structure and have it pass there through so that it extends outwardly from that said sheet.

6. A hand-held skiing stabilizer, comprising a pair of similarly shaped sheets of semirigid material; means attaching said sheets together about their edges; handhole means extending through one of said sheets inwardly from the edge margins thereof to form a handle; means spreading and holding the two sheets apart in the area of the handle, so that a hand grasping the handle passes partially through said handhole means in the one sheet, but does not pass through the other sheet; a hole in that sheet which does not have the handle means; and a tongue extending from attachment inside the stabilizer, through the hole and away from the stabilizer, so that two similar stabilizers may be interconnected by means of said tongues and said holes for ease of carrying.

* * * * *